US005779736A

United States Patent [19]

Frederick et al.

[11] Patent Number: 5,779,736

[45] **Date of Patent: *Jul. 14, 1998**

[54] PROCESS FOR MAKING FIBRILLATED CELLULOSE ACETATE STAPLE FIBERS

[75] Inventors: Tim J. Frederick; Melvin G. Mitchell; Lee R. Partin; Alan K. Wilson; Richard D. Neal, all of Kingsport, Tenn.

[73] Assignee: Eastman Chemical Company, Kingsport, Tenn.

[ * ] Notice: The term of this patent shall not extend beyond the expiration date of Pat. No. 5,662,773.

[21] Appl. No.: 375,140

[22] Filed: Jan. 19, 1995

[51] Int. Cl.[6] ..... D06M 11/00

[52] U.S. Cl. ..... 8/130; 8/125; 8/129; 162/146; 162/9; 162/157.6; 162/182; 162/100; 264/143; 264/200; 264/208; 264/290.7; 264/211.12; 428/373; 428/365; 428/375

[58] Field of Search ..... 162/146, 9, 157.6, 162/182, 100; 8/125, 129, 130; 264/143, 200, 208, 290.7, 211.12; 428/373, 365, 375

[56] References Cited

U.S. PATENT DOCUMENTS

| | | | |
|---|---|---|---|
| 2,116,063 | 5/1938 | Dreyfus | 8/130 |
| 3,595,605 | 7/1971 | Kimmig | 8/130 |
| 4,040,856 | 8/1977 | Litzinger . | |
| 5,102,501 | 4/1992 | Eber et al. . | |
| 5,234,720 | 8/1993 | Neal et al. | 427/393.1 |
| 5,505,888 | 4/1996 | Mitchell et al. | 264/138 |
| 5,573,640 | 11/1996 | Frederick et al. | 162/146 |

FOREIGN PATENT DOCUMENTS

| | | |
|---|---|---|
| 49-6761 | 2/1974 | Japan . |

OTHER PUBLICATIONS

Y. Fahmy and S. El-Kalyoubi, "on Fibrous Acetylation of Cellulose. Acetylation of Paper Pulps", Cellulose Chemistry and Technology, 4, 1970, pp. 613–619 (Month Unknown).

Synthetic Fibers in Papermaking, D. G. Bannerman, O. A. Battista, Interscience, New York 1964, pp. 69–70, 89, 273–277 (Month Unknown).

Chemical Abstract No. 1216915, Modification of Paper Properties by the Chemical Modification of Pulp, Kapustova, Justina; Letenay, Alexej (Vysk. Ustav Papieru Celul., Bratislava, Czech.), (1970) (Month Unknown).

*Primary Examiner*—Alan Diamond

*Attorney, Agent, or Firm*—Karen A. Harding; Harry J. Gwinnell

[57] ABSTRACT

The present invention discloses a process for producing a fibrillated cellulose acetate fiber comprising contacting cellulose acetate fiber with a strong base solution at conditions sufficient to remove greater than about 5% of bulk acetyl groups from said cellulose acetate fiber. Modified cellulose acetate staple fiber comprising an outer layer of regenerated cellulose in which at least about 5% of the acetyl groups are removed on an overall fiber basis are also disclosed. Paper products incorporating said fibers are also disclosed.

19 Claims, No Drawings

PROCESS FOR MAKING FIBRILLATED CELLULOSE ACETATE STAPLE FIBERS

FIELD OF THE INVENTION

The invention relates to a process for producing fibrillated cellulose acetate fibers which are suitable for use in various papers. Cellulose acetate fibers produced thereby and paper products including said fibers are also disclosed.

BACKGROUND OF THE INVENTION

U.S. Ser. No. 08/245,117, filed May 17, 1994 discloses a process for converting filter tow into cellulose acetate staple fiber as a paper additive. The process involves six steps: (1) filter tow feed system, (2) a water bath for lubricant removal, (3) drafting for crimp removal, (4) drying, (5) staple cutting and (6) packaging. Staple cut filter tow is a potential paper additive but the fibers are not well bonded into the sheet and Tinting occurs when the paper is printed.

U.S. Ser. No. 08/375,765, filed Jan. 19, 1995, (Docket 70114) discloses a process for preparing a similar product using as the feedstock cellulose acetate fibers reclaimed from the waste from cigarette manufacturing.

A caustic treatment process for fibers is disclosed in U.S. Pat. No. 5,234,720. The process is disclosed as a possible treatment step prior to lubricant addition. It consists of three steps: (1) adding caustic to the fibers, (2) heating the fiber to >130° C. for a few seconds, and (3) substantially neutralizing the excess caustic with a suitable acid solution such as acetic acid. U.S. Pat. No. 5,234,720 also discloses related lubricant technology.

Japanese patent application Sho 49(1974)-15471 discloses a process for saponifying rod waste from cigarette manufacture to convert it into a paper additive. The rod waste is made up of filter tow, plasticizer and plugwrap paper. Rod waste is added to water in a beater, mixed and heated to 75 C, and reacted with caustic soda for an extended time. At least about 50% of the acetyl (measured as acetic acid removed) is removed from the fiber by saponification. However, the high degree of acetyl removal negates many of the fiber addition benefits including bulking, increased porosity and thermoplasticity.

The ability to saponify cellulose acetate with a base is well known and previous researchers have studied the application of saponification in the production of a cellulose acetate additive for paper. For example, Fahmy and Koura [Y. Fahmy and S. El-Kalyoubi, *Cellulose Chem. Technol.*, 4, 613–619 (1970)] discloses producing a paper additive by acetylation of cotton and rice straw pulps followed by hydrolysis. According to Fahmy the acetylation is necessary to insure homogeneity of acetyl group distribution throughout the fiber, even after hydrolysis. Only fibers with homogeneous or near homogeneous acetyl group distribution have the properties disclosed by Fahmy.

Moreover, prior art fiber additives could not be added directly to the paper stock and required a special step. Frequently man-made fiber such as nylon or polyester require a binder or adhesive. Synthetic Fibers in Papermaking, D. G. Bannerman, O. A. Battista, INterscience, New York 1964, pp. 69–70, 89, 273–277.

DESCRIPTION OF THE INVENTION

The present invention discloses a process for producing a fibrillated cellulose ester and preferably a cellulose acetate fiber comprising contacting cellulose acetate fiber with a strong base solution at conditions sufficient to remove greater than about 5% of bulk acetyl groups from said cellulose acetate fiber.

Modified cellulose ester fiber comprising an outer layer of regenerated cellulose in which at least about 5% of the ester groups are removed on an overall fiber basis are also disclosed. The fibers of the present invention are useful as paper additives. The addition of the fibers of the present invention improves paper properties including increased porosity and decreased density. It also adds thermoplasticity to the paper.

The raw material for the process is cellulose ester fiber and preferably cellulose acetate. Such fiber is frequently made into filter tow and the feed material may either be a fiber yarn or filter tow.

Filter tow is produced as a tow band with fibers in the 1 to 10 denier per filament range and a total tow denier of 10,000 to 80,000. The tow band is crimped to meet the requirements of its application in cigarette filters. It is normally packaged in bale form of 500 to 2,000 lbs per bale. The feed for the process of the present invention may be uncrimped cellulose acetate fiber, uncrimped filter tow or crimped and baled tow. However, if the tow is crimped and baled it is preferably transformed back into a tow band prior to hydrolysis. The crimp must also be substantially removed.

When the feed is in bale form larger bale sizes are preferred for longer run time on a bale. Larger total denier is also preferred since fewer bales must be processed to meet a target production rate.

Preferably several bales are processed simultaneously as required to meet an overall target on total denier. Conventional tow feed systems may be used to feed the bales into the processing line. For example, the processing line can be designed for 525,000 total denier by processing 15 bales of 35,000 total denier tow simultaneously. The feed system withdraws the tow from the bales, tensions it to a common level and combines them into a tow band for the next step. Tow withdrawal is achieved through tow guides, tow tensioning devices and a set of pull rolls. This equipment is known in the filter tow art.

The processing line speed along with the total denier sets the line production rate. The line speed is typically in the range of 10 to 250 meters/min. Production facilities are normally at 140+ meters/min to optimize the line productivity.

Surface Fibrillation

The tow band is treated with a strong base to create the desired fibrillated surface. The pH must be greater than approximately 13.4. The high pH can be achieved with sodium hydroxide solutions of greater than about 1 wt %. For sodium hydroxide, the operating range is between 1 and 8 wt % in water.

The caustic strength is set to match the desired acetyl removal from the cellulose acetate for a target application rate. Each mole of NaOH removes one mole of acetyl by reaction to form sodium acetate. The process is capable of removing acetyl to get from 1 to 6% weight loss in the cellulose acetate.

To prevent Tinting of the fibers it is necessary to remove at least about 5% of the acetyl groups from the fiber. The majority (about 50% or greater) of the acetyl from the surface of the fiber (the outer 100 Angstroms) is removed. Preferably greater than about 75% of the acetyl is removed from the surface of the fiber.

Preferably between about 5 and about 15% of the acetyl groups are removed from the fiber. At acetyl removal of greater than about 15% the properties of the paper (porosity, density and thermoplasticity) degrade. Accordingly, the amount of acetyl removal is most preferably about 10%.

The base solution is applied to the filter tow band to obtain a set water take-up of the fiber. The preferred method of applying the base solution is to pass the tow band through a bath of the solution followed by pinch rollers and/or scraper blades to squeeze off the excess liquid and obtain the target water take-up. This achieves the full wetting of the fibers and provides for control of the water take-up by adjustment of the squeeze pressure. The water take-up by the fiber is best operated in the range of 0.5 to 1.0 lbs of water per lb of cellulose acetate.

The base application can be operated at various temperatures from the solution freezing point to its boiling point. It is preferred to operate at room temperature, 25° C. This avoids adding heating or cooling equipment. Elevated temperatures do increase the reaction rate for the base but a fast reaction within the application step makes it harder to start-up and operate. An immersed tow band in hot base quickly loses its strength and breaks.

Crimp Removal

Much of the crimp is removed during base application. However, any remaining crimp must be at least substantially removed to prevent fiber knotting problems in the finished paper product. Preferably the crimp is removed early within the process. This produces an even tow band that is easier to process in later steps. Otherwise, the tow band will have tight and loose areas.

The crimp is preferably removed by a combination of tension and heat. Tension is provided by pulling the tow band from the base addition rolls by another set of rolls. The heat can be either indirect heating or by direct heating with atmospheric sparge steam in a steam tube. The tow band heating also has the benefit of promoting the base reaction.

Holdup

Holdup time provides the time that it takes to perform the majority of the acetyl reaction. It could be as little as 1 minute to obtain the majority of the reaction or several hours to reach <8 pH. Optimization of the holdup conditions (temperature, time, agitation and concentration and nature of the base used) are within the skill in the art. A conveyor system may be used to obtain a few minutes holdup within a continuous process. An alternate design is to puddle the tow band into a container and store it for several hours before continuing with its processing. Any other conventional means may be used to provide the necessary holdup.

Washing

The acetyl reaction generates a byproduct. When sodium hydroxide is used, the byproduct is sodium acetate. The reaction byproduct is removed by water washing. Much of the mineral oil lubricant is also washed off. A typical configuration includes a fresh water supply, water trough, water heater, squeeze rolls, water recirculation pump and water purge to wastewater treatment. Other conventional configurations may be used. The tow band dips into the water for a brief time as required to thoroughly wet it. A one second contact time is sufficient.

The tow rises from the water and passes through pinch rolls that squeeze water from the tow band. The pressure on the pinch rolls is set to obtain good water removal with a target of about 10 to about 50 wt % water in the tow. The bath water temperature is controlled in the range of about 20° C. to about 90° C. with a preferred temperature range of about 30° to about 50° C. by a heater. The water may be recirculated within the water trough. Fresh water is added to the water bath in excess and the excess water overflows to the sewer along with the removed byproduct.

The water washing step could be deleted from the process. If the step is deleted, then the product would contain a significant amount of sodium acetate. However, the sodium acetate would have to be purged from the papermaking process.

Mineral oil is difficult to remove completely. When other lubricants are used, it may be important to remove the majority of the mineral oil. Additional rinsing or scouring additives and/or other washing aids followed by optional additional water washing may be used to insure removal of a majority of the mineral oil. Suitable additives and aids are generally known in the art.

Adjustment of the pH

Although a neutralization step is used in certain prior-art processes and/or methods, such as described in U.S. Pat. No. 5,234,720, it is not required in the process of the present invention. Such alteration could be needed in either acid or base directions. Instead a novel pH-adjustment step is used to insure the fiber produced has the desired pH. For example, many in the paper making industry prefer neutral materials because of the ease of handling.

This pH-adjustment step could be accomplished by several means, such as by dip bath, spray from jets, rotating application rolls, etc., followed, if needed, by squeeze rolls, an optional drying step, suitable controls, and other appropriate components. In fact, the design of the equipment for both the water-washing step and the lubricant-addition step could be such that washing, adjustment of pH and lubricant application could accomplished in the appropriate sequence essentially using a single multi-purpose device.

Lubricant Addition

Successful cutting of the tow band requires a lubricant. The fiber packs tightly between the blades if it has no lubricant or too little lubricant. The task of the lubricant addition equipment is to add the correct amount of an acceptable lubricant evenly over the tow band. The same mineral oil that is applied to filter tow is an acceptable lubricant for cutting. It is acceptable on the final product if its concentration is kept low. At concentrations greater than about 0.5 wt %, it causes foaming problems in the papermaking operation.

The preferred lubricant addition process consists of a lubricant feed system, a lubricant applicator and a set of squeeze rolls. The proper lubricant concentration in water is prepared in the feed system. It is pumped to the applicator where it is spread onto the moving tow band. The lubricant is then squeezed into the tow band by squeeze rolls and the excess water and lubricant is squeezed off.

For mineral oil, the proper lubricant concentration is in the range of 0.15 to 0.4 wt % lubricant on the tow band. The water concentration following the squeeze rolls is in the range of 10 to 30 wt %. Lubricants which use various mineral oils as the major component can be tacky and tend to be relatively hydrophobic.

In certain applications, a suitable hydrophilic lubricant could promote movement of aqueous solutions and/or alter the cohesiveness of the fibers. Such lubricants are selected based upon the needs of the end products and can include PEG 400 monolaurate, PEG 600 monolaurate, ethoxylated sorbitan monolaurate or monostearate and/or suitable mixtures of these. Other lubricants could also be used.

The hydrophilic lubricant may be used alone or with at least one antistatic agent. A minor amount of an approved antimicrobial agent could be useful to control or prevent the development of mold and/or fungus in or on certain paper products in which these fibers are used. In addition, in many applications, it is very important to include a minor amount of a suitable antifoaming agent in the lubricant composition. A suitable example is QS produced by Wacker Chemical Co.

Drying

Excess water is then removed from the chemically treated, lubricated tow band as required to meet the product specifications. Generally, the water specification for the cellulose acetate bands is set by the cutters and is in the range of about 2 wt % to about 15 wt % with a typical target of about 10 wt %.

The preferred drying equipment consists of a tow spreader to lay the tow band in a pattern on the dryer apron along with an air jet to fluff the tow band as it lays on the apron, and a conveyor dryer with recirculating hot air that passes through the tow band and dryer apron. The apron continuously moves through the dryer zone where hot air heats the tow band and evaporates the water.

The key operating and equipment design parameters are: (1) residence time within the conveyor dryer in the range of about 30 seconds to about 10 minutes, (2) hot air temperature in the range of about 65° C. to about 150° C., (3) hot air velocity as it contacts the tow in the range of about 0.5 to about 3 ft/sec, and (4) fresh air feed to the recirculating hot air to keep its relative humidity low, preferably below about 50% relative humidity. The operating conditions are adjusted to meet the target product water composition.

Staple Cutting

Next the tow band must be cut to the required length. A standard tow staple cutter is used to pull the tow band from the dryer apron and cut it into short cut staple. The cut length is in the range of about ⅛ inch to about ¾ inch, preferably about ¼ inch to about ½ inch. For a Lummus-style, outside-in cutter, the minimum required lubricant is about 0.2 wt % for cutting at about ¼ inch. Cutting is difficult and the blades break frequently at lower lubricant levels.

Tow moisture level is also important for the cutting step. In a Lummus-style, outside-in cutter, the preferred moisture target is in the range of about 5 to about 12 w% water. At high moisture levels, the product packs in the cutter head and it discharges poorly.

Packaging

The product can be packaged in bags, boxes or bales. The preferred package for application in the paper industry is the bale form. In the preferred process, the product is transferred from the cutter to a standard baler. The important design feature of the system is to produce a bale that can be processed easily by the paper company. This is accomplished by wrapping the bale in standard pulp sheets and fastening the bale with paper rope or wire straps.

Alternate Process

Alternatively the staple cutting may be performed prior to the treatment with a base chemical. The steps are: (1) tow feed system, (2) crimp removal, (3) staple cutting, (4) base treatment and reaction, (5) dewatering and (6) packaging. The first three steps are as described above. The tow band cuts well in a standard staple cutter with the lubricant that is already present on the filter tow. However, the next three steps are significantly different from the process described above.

The base treatment is performed by mixing the staple-cut filter tow with a basic solution of >11 pH in a stirred vessel and mixing until the reaction proceeds to near completion. The basic chemical can be selected from a wide variety of chemicals that form solutions having a pH greater than about 11, such as hydroxides and carbonates. The amount of base added is determined as required to achieve the desired acetyl removal.

The reaction temperature is set in the range of about 20° C. to about 100° C. The typical solids concentration in the vessel is in the range of about 0.5 to about 10 wt %.

The treated tow fiber is dewatering in standard dewatering equipment such as a centrifuge. Standard equipment can achieve a water concentration of about 40 to about 60 wt % water in the fiber.

Since it would be quite expensive to dry so much water from the product in a conventional solids dryer, the product is left wet. The product is baled with the high moisture content.

Surprisingly the fibers of the present invention may be added directly to the paper stock without the addition of glue or size. The fibers are conveniently added in bale form along with bales of wood pulp at the front end of the papermaking process.

Fibrillated cellulose acetate fibers

The process of the present invention produces a new cellulose acetate fiber having a fibrillated surface. The standard fiber acetyl level is about 55 wt % combined acetic acid and the denier per filament is in the range of about 1 to about 30 dpf.

The outer surface of the fibers of the present invention contains a layer of regenerated cellulose in which about 50% or more of the acetyl groups (preferably, about 75% or greater) are removed. For example, the fiber acetyl level may drop from about 55 wt % to about 51 wt % combined acetic acid as the cellulose layer is formed to obtain an acceptable cellulose layer. This is substantially higher than the upper acetyl content limit disclosed by Fahmy (about 18 wt % combined acetic acid).

The removal of acetyl groups creates a rough surface that fibrillates during pulping when introduced as a paper additive.

The individual fiber length is acceptable as a paper additive. The staple length ranges from about ⅛ inch to about ¾ inch, and preferably is about ¼ inch.

The resulting fiber performs well as a paper additive. The surface treatment of the present invention is required to obtain good fiber bonding into the sheet. Without the caustic treatment, the fibers will lint during the paper printing operation. Moreover, it has been surprisingly found that the fibers of the present invention may be added directly to the papermaking process with the wood pulp.

The fibers of the present invention may be added to wood pulp to make paper products. The amount of fiber added is about 1 and about 90% by weight of the finished product. Preferably the amount of fiber added is between about 5 and about 90 weight % and more preferably between about 10 and about 85 weight %.

EXAMPLE 1

One bale of cellulose acetate filter tow of 3.2 actual denier per filament and 31,300 gm/9000 m denier was processed through the tow line running at 40 m/min. to produce a tow band. The crimp was removed under tension using a heater at 130° C. and sparge steam on the tow. The decrimped band was cut to ¼ inch on a Lummus Model 66 cutter.

Cut tow fiber (1,500 dry grams) was mixed with 60.3 grams of sodium hydroxide and 23.7 kg of water. The solution was mixed for 1 hour in a small vessel. The reaction proceeded at room temperature (approximately 25° C.). The product was centrifuged to remove most (about 40 wt % solids) of the water.

EXAMPLE 2

Six cellulose acetate filter tow bands were fed to a polyester processing tow line operating at 37 m/min. The average tow band denier was 32,750 gm/9000 m.

The combined tow band was dipped in 4.1 wt % NaOH solution at 40° C. The excess caustic was squeezed off the tow band to obtain 0.81 lb liquid per lb of cellulose acetate. The tow band was puddled in a box and stored for 3 hours.

After the three hour holdup, the tow band was fed back through the tow line running at 40 m/min. The tow band was dipped into a fresh water bath at 40° C. with excess fresh water addition. Squeeze rolls at the water bath removed most of the water from the tow band. Additional water was squeezed off the tow band in a second set of rolls to obtain approximately 20% moisture on the tow band.

The tow was dried in a conveyor dryer with recirculating air at 95° C. and a 2 minute residence time. Mineral oil (10 wt % in water) was sprayed onto the tow band to lubricate it resulting in 0.17 wt % lubricant and 11 wt % water on the tow band. The product was cut in a Lummus Model 66 cutter at ¼ inch staple length.

The product analysis showed approximately 3.3% loss in weight for the cellulose acetate.

EXAMPLE 3

Six cellulose acetate filter tow bands were fed to the tow line operating at 30 m/min. The combined tow band was dipped in 5.0 wt % NaOH solution at 40° C. The excess caustic was excess caustic was squeezed off the tow band to obtain 0.75 to 0.95 lb liquid per lb of cellulose acetate.

The tow band was pulled under tension through a steam chest containing sparge steam operating at approximately 100° C. The tow band was puddled in a box and stored for approximately 1 day.

After the holdup the tow band was fed back through the tow line running at 30 m/min. The tow band was dipped into a fresh water bath at 40° C. with excess fresh water addition. Squeeze rolls at the water bath removed most of the water from the tow band.

Approximately 3 wt % mineral oil in water was pumped on the tow band to lubricate it. Liquid was squeezed off the tow band in a second set of rolls to obtain approximately 20% moisture on the tow band.

The tow was dried in a conveyor dryer with recirculating air at 98° C. and a 1.5 minute residence time. The product was cut in a Lummus Model 66 cutter at ¼ inch staple length. The product had approximately 0.25 wt % mineral oil and 9 wt % water.

EXAMPLE 4

Filter tow of 3.2 dpf was washed, decrimped, dried and staple-cut at ¼ inch as described in Example 1. The fibers were saponified in a mixing tank using a weak caustic solution. The amount of NaOH addition was set to achieve samples with an overall removal of 0.5%, 5% and 10% of the acetyl groups on the cellulose acetate. The reaction was monitored by pH measurements and the mixture was stirred until the reaction was completed as indicated by a pH of 8 or less. The product was centrifuged to remove most of the water.

Paper was produced using the new material as 8 wt % of the fiber to make standard offset printing papers of 40 and 60 lb book weights.

The test papers were printed at Inove Graphics Inc. in Kingsport, Tenn. to determine their acceptability for offset printing applications. The control sheet made with 8 wt % of non-hydrolyzed acetate fibers showed heavy linting on all blankets of the offset printing press. Linting was also present to an unacceptable level on the samples made with fiber that was treated to remove 0.5% and 5% of the acetyl groups. The paper made with 8 wt % acetate fiber at 10% of the acetyl groups removed showed an acceptable lint rating for commercial applications with minimal linting.

The surface of the caustic-treated cellulose acetate fibers was analyzed by Electron Spectroscopy for Chemical Analysis (ESCA) and microscopy. ESCA was used to determine the acetyl degree of substitution (DS) per anhydroglucose unit of the top 50–100 angstroms of the fibers. The treated samples (0.5, 5 and 10%) showed surface acetyl levels of 1.8, 0.4, and 0.3 DS, respectively. In untreated cellulose acetate fibers this DS was about 2.5 whereas fibers treated with sufficient caustic were essentially cellulose (DS <0.4). Thus, the samples with 5% and 10% of the acetyl groups removed were essentially cellulose on the surface.

Microscopy was also used to look at the surface smoothness (fibrillation) of the samples. Untreated cellulose acetate was fairly smooth; however, with sufficient caustic surface treatment the surface was very rough and fibrillated. The presence of regenerated cellulose on the surface was not sufficient to cause fibrillation until about 5–10 % of the acetate had been removed. Both the 5 and 10% samples showed surface changes of fibrous networks and evidence of a "skin" peeling off. Clearly the fibers of the present invention have a non-homogeneous acetyl distribution.

EXAMPLE 5

This Example shows that the process of the present invention and fibers produced thereby are different than those disclosed in the prior art.

Samples were generated at various acetyl levels by as in Example 4. Handsheets were produced using 20 wt % of the new product and 80 wt % of standard wood pulp that is 50 wt % hardwood and 50 wt % softwood. All samples were refined to 250 ml Canadian Standard Freeness and 100 gm/sqm handsheets were generated. The density of the resulting papers was measured and a bulking factor which indicates the amount of bulking added by a specified amount of the various fibers generated was calculated as follows.

$$\text{Bulking factor} = \frac{\dfrac{(d_{control} - d_{paper\ w/fiber})}{d_{control}}}{\text{mass fraction}_{fiber\ added}}$$

Table 1 presents the handsheet paper density as a function of the acetyl level.

TABLE 1

Tensile Strength v. Acetyl Level

| % Acetyl removed wt % combined acetic acid | Paper Density (gm/cc) | bulking factor |
|---|---|---|
| 0 | 0.48 | 0.97 |
| 8.6 | 0.48 | 0.92 |
| 14.0 | 0.49 | 0.84 |
| 33.5 | 0.49 | 0.82 |
| 48.2 | 0.50 | 0.75 |
| 61.1 | 0.50 | 0.65 |
| 72.5 | 0.51 | 0.72 |
| paper wo/fiber | 0.59 | — |

The paper density increases and bulking factor decreases at acetyl removal levels outside of the present invention. Even though the changes in density are quite small, they correspond to substantial decreases in bulking. Moreover, there is clearly a sharp drop in density between the 8.9 and 14% losses. While the 14% sample provides adequate density, about 10% loss is preferred. Hydrolyzing to the levels disclosed in the prior art does not provide fibers which provide the papers to which they are added with the desired density. However, surprisingly, the fibers of the present invention do provide the desired density.

We claim:

1. A process comprising: contacting cellulose acetate fiber with a strong base solution having a pH of greater than about 11 at conditions sufficient to remove from at least about 5% to about 10% of bulk acetyl groups from said cellulose acetate fiber.

2. The process of claim 1 wherein said strong base has a pH of greater than about 13.

3. The process of claim 1 wherein about 10% of said acetyl groups are removed.

4. The process of claim 1 wherein said base solution is maintained at a temperature between freezing point and boiling point of said base solution.

5. The process of claim 4 wherein said temperature is room temperature.

6. The process of claim 2 wherein said cellulose acetate fiber is pH adjusted to about 7 after said contacting step.

7. The process of claim 6 wherein said fiber is a tow band.

8. The process of claim 7 wherein said contacting step is accomplished by passing said tow band through a bath of said strong base and squeezing off excess base.

9. The process of claim 8 further comprising the step of applying sufficient heat and tension to remove crimp from said tow band.

10. The process of claim 9 further comprising the steps of:

washing said tow band;

lubricating said tow band;

drying said tow band and cutting said tow band to between about ⅛ and ¾ of an inch.

11. The process of claim 1 wherein said cellulose acetate fiber is a decrimped, cut fiber and said contacting step is accomplished by mixing said cut fiber with said base in a vessel to remove said bulk acetyl groups.

12. The process of claim 11 wherein said contacting step is conducted at a temperature between about 20° C. and about 100° C.

13. The process of claim 12 further comprising the step of dewatering the deacetylated fiber product.

14. A modified cellulose acetate fiber comprising an outer layer having a thickness of 100 Angstroms wherein from at least about 5% to about 10% of acetyl groups in the fiber are removed on an overall fiber basis and at least about 50% of the acetyl groups removed are removed from the outer layer.

15. The fiber of claim 14 wherein about 10% of the acetyl groups are removed on an overall fiber basis.

16. The fiber of claim 14 further comprising a denier per filament of between about 1 and about 30 dpf.

17. The fiber of claim 14 wherein at least about 75% of the acetyl groups in the outer layer of the fiber are removed.

18. The fiber of claim 14 wherein the fiber is uncrimped.

19. A process comprising:

contacting cellulose ester fiber with a strong base solution having a pH of greater than about 13.4 at conditions sufficient to remove from at least about 5% to about 10% of ester groups from said cellulose ester fiber.

* * * * *